US011004457B2

(12) United States Patent
Liao et al.

(10) Patent No.: US 11,004,457 B2
(45) Date of Patent: May 11, 2021

(54) SOUND REPRODUCING METHOD, APPARATUS AND NON-TRANSITORY COMPUTER READABLE STORAGE MEDIUM THEREOF

(71) Applicant: HTC Corporation, Taoyuan (TW)

(72) Inventors: Chun-Min Liao, Taoyuan (TW); Yan-Min Kuo, Taoyuan (TW)

(73) Assignee: HTC Corporation, Taoyuan (TW)

( * ) Notice: Subject to any disclaimer, the term of this patent is extended or adjusted under 35 U.S.C. 154(b) by 184 days.

(21) Appl. No.: 16/162,421

(22) Filed: Oct. 17, 2018

(65) Prior Publication Data

US 2019/0122681 A1 Apr. 25, 2019

Related U.S. Application Data

(60) Provisional application No. 62/573,706, filed on Oct. 18, 2017.

(51) Int. Cl.

| | |
|---|---|
| ***G10L 19/032*** | (2013.01) |
| ***G10L 19/008*** | (2013.01) |
| ***H04S 3/00*** | (2006.01) |
| *H04S 7/00* | (2006.01) |

(52) U.S. Cl.

CPC ..... *G10L 19/032* (2013.01); *G10L 19/008* (2013.01); *H04S 3/008* (2013.01); *H04S 7/303* (2013.01); *H04S 2420/01* (2013.01); *H04S 2420/11* (2013.01)

(58) Field of Classification Search

None

See application file for complete search history.

(56) References Cited

U.S. PATENT DOCUMENTS

| | | | | |
|---|---|---|---|---|
| 7,280,664 | B2 * | 10/2007 | Fosgate | H04S 3/02 381/19 |
| 7,660,424 | B2 * | 2/2010 | Davis | H04S 5/005 381/20 |
| 9,473,870 | B2 * | 10/2016 | Sen | H04S 3/006 |
| 9,628,934 | B2 * | 4/2017 | Davis | H04S 5/005 |

(Continued)

FOREIGN PATENT DOCUMENTS

| | | | |
|---|---|---|---|
| CN | 101658052 | A | 2/2010 |
| CN | 103329567 | A | 9/2013 |

(Continued)

*Primary Examiner* — Jonathan C Kim

(74) *Attorney, Agent, or Firm* — CKC & Partners Co., LLC

(57) ABSTRACT

A sound reproducing method used in sound reproducing apparatus that includes the steps outlined below is provided. An input sound signal related to listener data and sound source data is received. An encoding process is performed by multiplying the input sound signal by an encoding function matrix having entries related to a basis function to generate an encoding result. A decoding function matrix is retrieved from the storage and at least one direction parameter is applied to the decoding function matrix, wherein the decoding function matrix compensates a difference between an ideal approximation result and a modeled approximation result of the input sound signal. A decoding process is performed by multiplying the encoding result by the decoding function matrix having the direction parameter applied to generate an output sound signal. The output sound signal is reproduced.

17 Claims, 4 Drawing Sheets

(56) References Cited

U.S. PATENT DOCUMENTS

| | | | | |
|---|---|---|---|---|
| 9,743,210 | B2 * | 8/2017 | Borss | H04S 3/02 |
| 10,375,496 | B2 * | 8/2019 | Samuelsson | H04S 7/303 |
| 10,431,227 | B2 * | 10/2019 | Disch | H04S 3/02 |
| 10,448,185 | B2 * | 10/2019 | Disch | G10L 19/22 |
| 10,607,615 | B2 * | 3/2020 | Paulus | G10L 19/008 |
| 10,764,709 | B2 * | 9/2020 | Breebaart | H04S 7/302 |
| 2008/0192941 | A1 * | 8/2008 | Oh | H04S 7/302 381/17 |
| 2009/0043591 | A1 * | 2/2009 | Breebaart | G10L 19/008 704/500 |
| 2012/0269353 | A1 * | 10/2012 | Herre | G10L 19/008 381/22 |
| 2015/0098597 | A1 * | 4/2015 | Kulavik | H04S 3/004 381/309 |
| 2016/0142846 | A1 * | 5/2016 | Herre | H04S 3/008 381/23 |
| 2017/0366912 | A1 * | 12/2017 | Stein | H04S 7/304 |
| 2018/0206058 | A1 * | 7/2018 | Murata | H04S 7/301 |
| 2018/0359596 | A1 * | 12/2018 | Breebaart | H04S 3/008 |
| 2019/0069110 | A1 * | 2/2019 | Gorzel | H04S 5/005 |
| 2019/0122681 | A1 * | 4/2019 | Liao | G10L 19/032 |
| 2020/0168235 | A1 * | 5/2020 | Bernard | H04S 5/02 |

FOREIGN PATENT DOCUMENTS

| | | | |
|---|---|---|---|
| CN | 104144370 | A | 11/2014 |
| CN | 107113528 | A | 8/2017 |
| WO | 2017118519 | A1 | 7/2017 |

* cited by examiner

SOUND REPRODUCING METHOD, APPARATUS AND NON-TRANSITORY COMPUTER READABLE STORAGE MEDIUM THEREOF

RELATED APPLICATIONS

This application claims priority to U.S. Provisional Application Ser. No. 62/573,706, filed Oct. 18, 2017, which is herein incorporated by reference.

BACKGROUND

Field of Disclosure

The present disclosure relates to sound reproducing technology. More particularly, the present disclosure relates to a sound reproducing method, a sound reproducing apparatus and a non-transitory computer readable storage medium thereof.

Description of Related Art

In recent years, virtual reality technology is widely used in the fields such as gaming, engineering and military, etc. In order to experience the virtual reality environment, a user needs to view the displayed frames displaying a virtual environment through the display apparatus disposed at such as, but not limited a head-mounted device (HMD) wear by the user. Further, the user can listen to the sound generated based on the virtual environment by using a sound reproducing apparatus disposed also at the HMD.

The sound signal reproduced by the sound reproducing apparatus can be modeled by using a mathematic method. However, since the computation resource is limited, some characteristics, such as but not limited to the directional components of the original sound signal may be lost during the modeling of the signal such that the reproduced sound may deviate from the original sound signal.

Accordingly, what is needed is a sound reproducing method, a sound reproducing apparatus and a non-transitory computer readable storage medium thereof to address the above issues.

SUMMARY

An aspect of the present disclosure is to provide a sound reproducing method used in sound reproducing apparatus that includes the steps outlined below. An input sound signal related to listener data and sound source data is received. An encoding process is performed by multiplying the input sound signal by an encoding function matrix to generate an encoding result, wherein a plurality of entries of the encoding function matrix are related to a basis function. A decoding function matrix is retrieved and at least one direction parameter is applied to the decoding function matrix, wherein the decoding function matrix compensates a difference between an ideal approximation result and a modeled approximation result of the input sound signal. A decoding process is performed by multiplying the encoding result by the decoding function matrix having the direction parameter applied to generate an output sound signal. The output sound signal is reproduced.

Another aspect of the present disclosure is to provide a sound reproducing apparatus that includes a storage, a sound playback circuit and a processor. The storage is configured to store a plurality of computer-executable instructions. The processor is electrically coupled to the storage and the sound playback circuit and configured to retrieve and execute the computer-executable instructions to perform a sound reproducing method when the computer-executable instructions are executed, wherein the sound reproducing method includes the steps outlined below. An input sound signal related to listener data and sound source data is received. An encoding process is performed by multiplying the input sound signal by an encoding function matrix to generate an encoding result, wherein a plurality of entries of the encoding function matrix are related to a basis function. A decoding function matrix is retrieved from the storage and at least one direction parameter is applied to the decoding function matrix, wherein the decoding function matrix compensates a difference between an ideal approximation result and a modeled approximation result of the input sound signal. A decoding process is performed by multiplying the encoding result by the decoding function matrix having the direction parameter applied to generate an output sound signal. The output sound signal is reproduced by the sound playback circuit.

Yet another aspect of the present disclosure is to provide a non-transitory computer readable storage medium that that stores a computer program including a plurality of computer-executable instructions to perform a sound reproducing method used in a sound reproducing apparatus, the sound reproducing apparatus at least includes a storage, a sound playback circuit and a processor electrically coupled to the storage and the sound playback circuit and configured to retrieve and execute the computer-executable instructions to perform the sound reproducing method when the computer-executable instructions are executed. The sound reproducing method includes the steps outlined below. An input sound signal related to listener data and sound source data is received. An encoding process is performed by multiplying the input sound signal by an encoding function matrix to generate an encoding result, wherein a plurality of entries of the encoding function matrix are related to a basis function. A decoding function matrix is retrieved from the storage and at least one direction parameter is applied to the decoding function matrix, wherein the decoding function matrix compensates a difference between an ideal approximation result and a modeled approximation result of the input sound signal. A decoding process is performed by multiplying the encoding result by the decoding function matrix having the direction parameter applied to generate an output sound signal. The output sound signal is reproduced by the sound playback circuit.

These and other features, aspects, and advantages of the present disclosure will become better understood with reference to the following description and appended claims.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
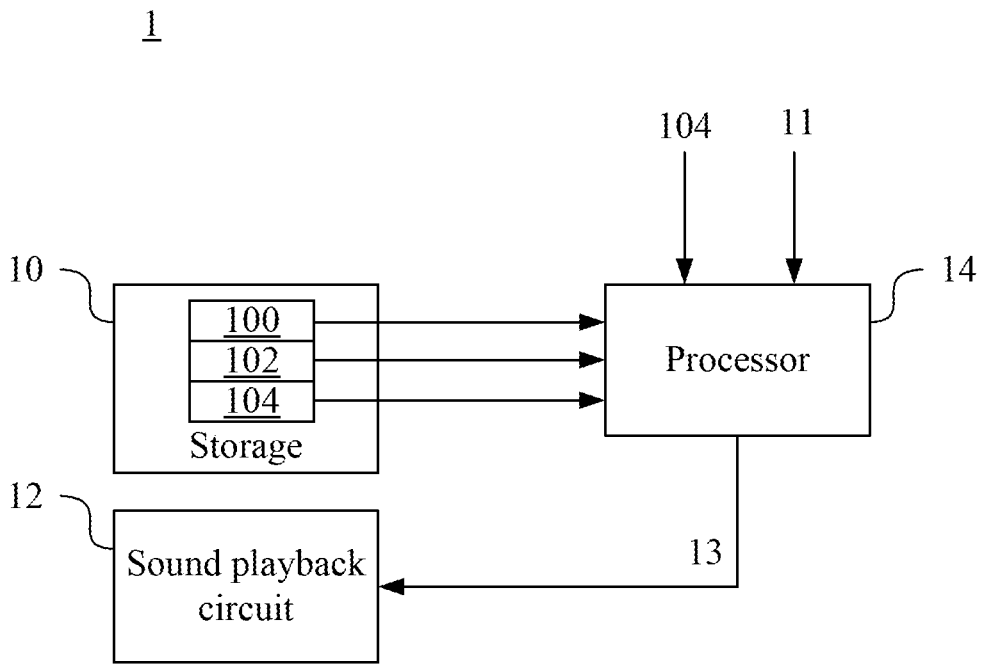
FIG. 1 is a block diagram of a sound reproducing apparatus in an embodiment of the present invention.

Reference will now be made in detail to the present embodiments of the disclosure, examples of which are illustrated in the accompanying drawings. Wherever possible, the same reference numbers are used in the drawings and the description to refer to the same or like parts.

It will be understood that, in the description herein and throughout the claims that follow, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Moreover, "electrically connect" or "connect" can further refer to the interoperation or interaction between two or more elements.

It will be understood that, in the description herein and throughout the claims that follow, although the terms "first," "second," etc. may be used to describe various elements, these elements should not be limited by these terms. These terms are only used to distinguish one element from another. For example, a first element could be termed a second element, and, similarly, a second element could be termed a first element, without departing from the scope of the embodiments.

It will be understood that, in the description herein and throughout the claims that follow, the terms "comprise" or "comprising," "include" or "including," "have" or "having," "contain" or "containing" and the like used herein are to be understood to be open-ended, i.e., to mean including but not limited to.

It will be understood that, in the description herein and throughout the claims that follow, the phrase "and/or" includes any and all combinations of one or more of the associated listed items.

It will be understood that, in the description herein and throughout the claims that follow, words indicating direction used in the description of the following embodiments, such as "above," "below," "left," "right," "front" and "back," are directions as they relate to the accompanying drawings. Therefore, such words indicating direction are used for illustration and do not limit the present disclosure.

It will be understood that, in the description herein and throughout the claims that follow, unless otherwise defined, all terms (including technical and scientific terms) have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any element in a claim that does not explicitly state "means for" performing a specified function, or "step for" performing a specific function, is not to be interpreted as a "means" or "step" clause as specified in 35 U.S.C. § 112(f). In particular, the use of "step of" in the claims herein is not intended to invoke the provisions of 35 U.S.C. § 112(f).

FIG. 1 is a block diagram of a sound reproducing apparatus 1 in an embodiment of the present invention. In an embodiment, the sound reproducing apparatus 1 is used in a head-mounted device (HMD). More specifically, the components of the sound reproducing apparatus 1 are disposed at various positions of the HMD.

The sound reproducing apparatus 1 includes a storage 10, a sound playback circuit 12 and a processor 14.

In an embodiment, the storage 10 can be such as, but not limited to CD ROM, RAM, ROM, floppy disk, hard disk or optic magnetic disk. The storage 10 is configured to store a plurality of computer-executable instructions 100.

The sound playback circuit 12 is configured to reproduce an output sound signal 13 generated by the processor 14. In an embodiment, the sound playback circuit 12 may include a first playback unit and a second playback unit (not illustrated) configured to playback a first channel sound and a second channel sound, in which a user that wears the HMD can put the first playback unit and the second playback unit into or close to the two ears of the user to hear the playback result.

The processor 14 is electrically coupled to the storage 10 and the sound playback circuit 12. In an embodiment, the processor 14 is configured to retrieve and execute the computer-executable instructions 100 to operate the function of the sound reproducing apparatus 1 accordingly.

Figure 2:
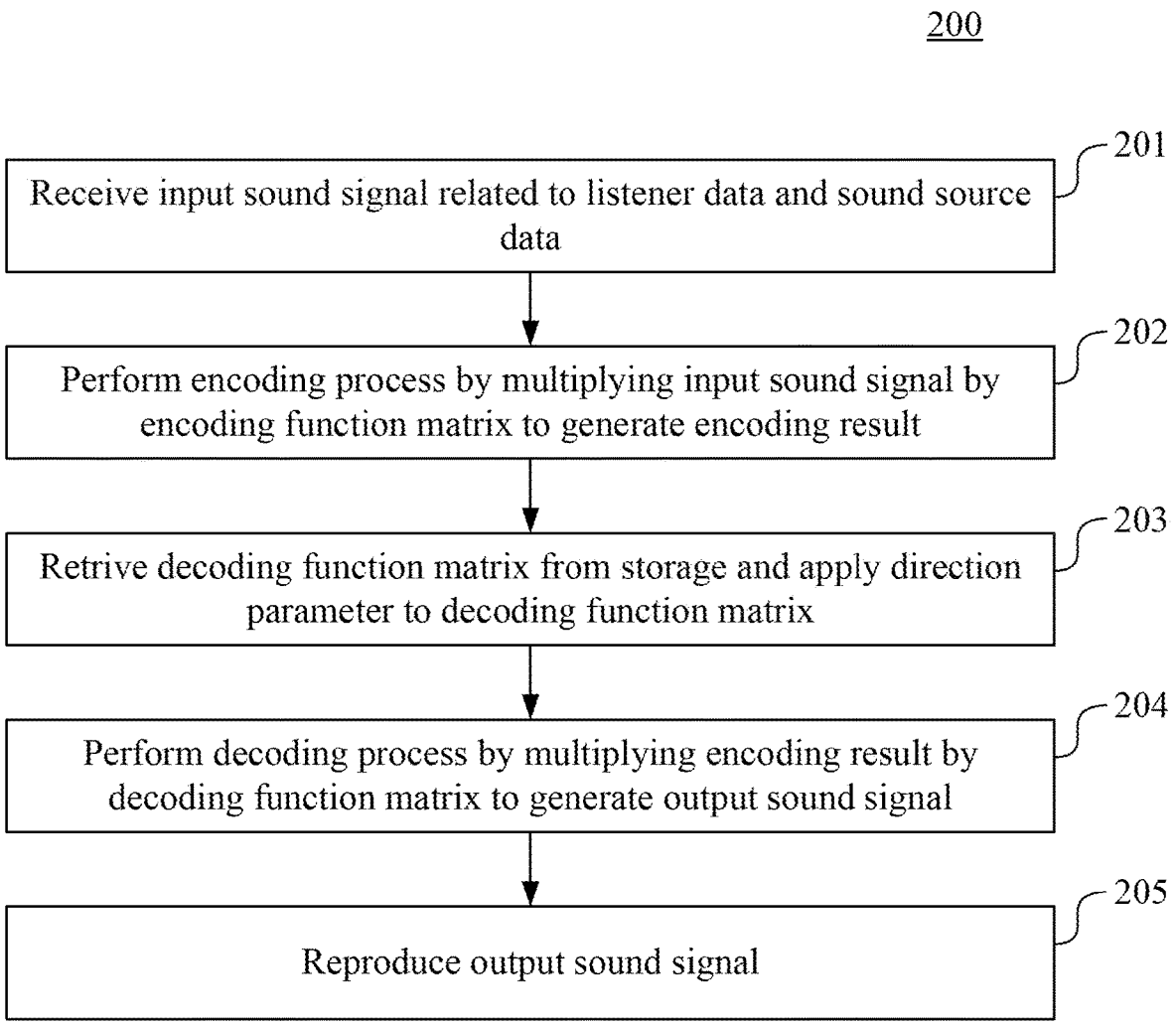
FIG. 2 is a flow chart of a sound reproducing method in an embodiment of the present invention.
Figure 3:
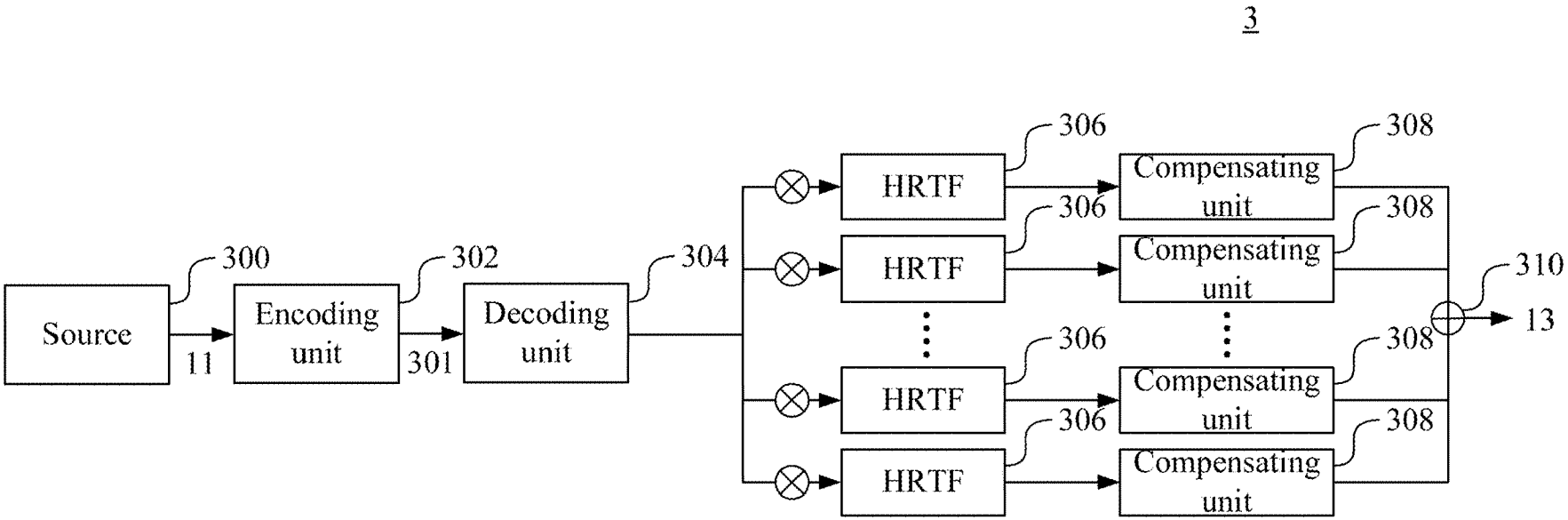
FIG. 3 is an exemplary diagram of a system in an embodiment of the present invention.

Reference is now made to FIG. 2 and FIG. 3. The detail of the function of the sound reproducing apparatus 1 is described in the following paragraphs in accompany with FIG. 1, FIG. 2 and FIG. 3.

FIG. 2 is a flow chart of a sound reproducing method 200 in an embodiment of the present invention. The sound reproducing method 200 can be used in the sound reproducing apparatus 1 illustrated in FIG. 1.

FIG. 3 is an exemplary diagram of a system 3 in an embodiment of the present invention.

In an embodiment, when the computer-executable instructions 100 is executed by the processor 14, the sound reproducing method 200 is performed to operate of the sound reproducing apparatus 1 as the system 3. The system 3 includes a source 300, an encoding unit 302, a decoding unit 304, a plurality of head-related transfer function (HRTF) converters 306 and a plurality of compensating units 308.

The sound reproducing 200 includes the steps outlined below (The steps are not recited in the sequence in which the steps are performed. That is, unless the sequence of the steps is expressly indicated, the sequence of the steps is interchangeable, and all or part of the steps may be simultaneously, partially simultaneously, or sequentially performed).

In step 201, an input sound signal 11 related to listener data 102 and sound source data 104 is received.

Figure 4:
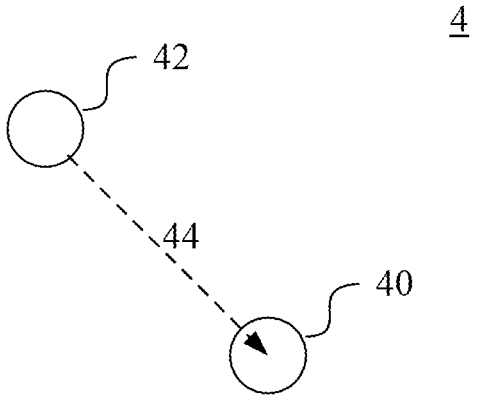
FIG. 4 is a diagram illustrating a listener and a sound source within a virtual environment in an embodiment of the present invention.

Reference is now made to FIG. 4 at the same time. FIG. 4 is a diagram illustrating a listener 40 and a sound source 42 within a virtual environment 4 in an embodiment of the present invention.

In an embodiment, the listener data 102 includes information of a position of the listener 40, i.e. the user of the HMD, in the virtual environment 4. The listener data 102 is stored in the storage 10 and can be updated in a real time manner depending on a process of a simulated scenario such as, but not limited to game or military training. The processor 14 is able to retrieve the listener data 102 from the storage 10.

In an embodiment, the sound source data 104 includes information of a position of the sound source 42 that generates a sound 44 in the virtual environment 4 perceived by the user. In an embodiment, the sound source 42 is equivalent to the source 300 illustrated in FIG. 3.

The sound source data 104 can be received through such as, but not limited to a network module (not illustrated) in the sound reproducing apparatus 1 by the processor 14 and can be generated during the process of the simulated scenario.

Based on the listener data 102 and the sound source data 104, the processor 14 can obtain the positions of the listener 40 and the sound source 42.

A transmission path of the sound 44 having a transmission direction is formed between the sound source 42 and the listener 40. The sound 44 may be generated during the process of the simulated scenario based on the input sound signal 11, in which the input sound signal 11 can be received through such as, but not limited to the network module (not illustrated) in the sound reproducing apparatus 1 by the processor 14. More specifically, when the input sound signal 11 is processed and reproduced by the sound reproducing apparatus 1, the user of HMD can perceive the sound 44.

In step 202, an encoding process is performed by multiplying the input sound signal by an encoding function matrix to generate an encoding result 301, wherein entries of the encoding function matrix are related to a basis function.

In an embodiment, the encoding process is performed by the encoding unit 302 illustrated in FIG. 3. The detail of the encoding process is described in the following paragraphs.

In an embodiment, the basis function is spherical harmonics, in which such a basis function is described as:

$$Y_{mn}(\theta, \varphi) = \sqrt{\frac{(2n+1)(n-m)!}{4\pi(n+m)!}}\, P_{mn}(\cos\theta).$$

Such as basis function is a function of the spherical angular coordinates θ and φ related to the transmission direction of input sound signal 11 and has an order defined by m and n.

In step 203, a decoding function matrix 106 is retrieved from the storage 10 and at least one direction parameter is applied to the decoding function matrix 106, wherein the decoding function matrix 106 compensates a difference between an ideal approximation result and a modeled approximation result of the input sound signal.

In an embodiment, a test sound signal $S_t$ can be approximated by encoding and decoding the test sound signal with a first encoding function matrix $Y_{mn}(\theta, \varphi)$ and a first decoding function matrix $D(\theta, \varphi)$ corresponding to the basis function having infinite indeterminates (the order defined by m and n is infinite) to generate an ideal approximation result $P(\theta_i, \varphi_i)$, in which the indeterminates correspond to different directional components of the test sound signal $S_t$. In an embodiment, the first decoding function matrix $D(\theta, \varphi)$ is an inverse matrix of the first encoding function matrix $Y_{mn}(\theta, \varphi)$.

As a result, the first decoding function matrix $D(\theta, \varphi)$ can be expressed as $D(\theta, \varphi)=(Y_{mn}(\theta, \varphi))^{-1}$. The ideal approximation result $P(\theta_i, \varphi_i)$ can be expressed as:

$$P(\theta_i,\varphi_i)=[D(\theta,\varphi)][Y_{mn}(\theta,\varphi)]S_t.$$

Further, the test sound signal $S_t$ can also be approximated by encoding and decoding the test sound signal by encoding and decoding the test sound signal with a second encoding function matrix $Y_{mn}'(\theta, \varphi)$ and a second decoding function matrix $D'(\theta, \varphi)$ corresponding to the same basis function but having finite indeterminates (the order defined by m and n is finite) to generate a modeled approximation result $P'(\theta_i, \varphi_i)$, in which the indeterminates correspond to different directional components of the test sound signal $S_t$. In an embodiment, the second decoding function matrix $D'(\theta, \varphi)$ is an inverse matrix of the second encoding function matrix $Y_{mn}'(\theta, \varphi)$.

As a result, the second decoding function matrix $D'(\theta, \varphi)$ can be expressed as $D'(\theta, \varphi)=(Y_{mn}'(\theta, \varphi))^{-1}$. The modeled approximation result $P'(\theta_i, \varphi_i)$ can be expressed as:

$$P'(\theta_1,\varphi_i)=[D'(\theta,\varphi)][Y_{mn}'(\theta,\varphi)]S_t.$$

The relation between the ideal approximation result $P(\theta_i, \varphi_i)$ and the modeled approximation result $P'(\theta_i, \varphi_i)$ can expressed as:

$$P(\theta_i,\varphi_i)=P'(\theta_i,\varphi_i)[P(\theta_i,\varphi_i)/P'(\theta_i,\varphi_i)]=P'(\theta_i,\varphi_i)f_i(\theta_i,\varphi_i)$$

The term $f_i(\theta_i, \varphi_i)$ stands for the difference between the ideal approximation result $P(\theta_i, \varphi_i)$ and the modeled approximation result $P'(\theta_i, \varphi_i)$. In an embodiment, the $f_i(\theta_i, \varphi_i)$ is calculated and is used as a compensation matrix to modify the second decoding function matrix $D'(\theta, \varphi)$.

As a result, by multiplying the second decoding function matrix $D'(\theta, \varphi)$ by the compensation matrix $f_i(\theta_i, \varphi_i)$, the decoding function matrix 106 is generated and can compensate the difference. In an embodiment, the decoding function matrix 106 is stored in the storage 10 and is retrieved when the decoding process is performed. Further, direction parameters of the input sound signal 11, e.g. θ and φ, are applied to the decoding function matrix 106, in which the direction parameters are parameters used to describe the transmission direction of the input sound signal 11.

It is appreciated that in the embodiment described above, the basis function in the form of spherical harmonics is used as an example. However, in other embodiments, other types of functions can be used as the basis function.

In step 204, a decoding process is performed by multiplying the encoding result 301 by the decoding function matrix 106 having the direction parameter applied to generate an output sound signal 13.

In an embodiment, the decoding unit 304 and the compensating unit 308 together performs the decoding process, in which the decoding unit 304 performs operation according to the second decoding function matrix me, go) and the compensating units 308 perform operation according to the compensation matrix $f_i(\theta_i, \varphi_i)$. When the number of the compensating units 308 is N, the compensating units 308 performs operation according to the compensation matrix $f_1(\theta_i, \varphi_i)$, $f_2(\theta_i, \varphi_i)$, . . . and $f_N(\theta_i, \varphi_i)$ corresponding to different direction components respectively.

In an embodiment, the HRTF converters 306 are selectively disposed in front of the compensating units 308, in which the HRTF converters 306 are configured to perform conversion based on the head-related transfer function. In other embodiments, the compensating units 308 can be disposed in front of the HRTF converters 306.

In an embodiment, since the direction parameters of the input sound signal 11 are applied and the compensation matrix $f_i(\theta_i, \varphi_i)$ is used, the decoding function matrix 106 enhances the directional components corresponding to a transmission direction of the input sound signal 11 (i.e. the direction of the transmission path of the sound 44 in FIG. 4) according to the difference.

In step 205, the output sound signal 13 is reproduced by the sound playback circuit 12.

In an embodiment, a mixing unit 310 illustrated in FIG. 3 can be disposed to further generate the output sound signal 13 as a binaural output form such that the output sound signal 13 can be reproduced by such as, but not limited to an earphone. In other embodiments, when a sound playback circuit 12 having more channels is sued, the mixing unit 310 can also generate the output sound signal 13 into a multi-channel form.

Further, in an embodiment, an inverse response corresponds to a frequency response characteristic of a sound playback circuit 12 used to reproduce the output sound signal 13 can be stored in the storage 10. As a result, the inverse response can be retrieved and applied to the output sound signal 13 such that the output sound signal 13 is further reproduced.

As a result, the directional quality of the output sound signal 13 is not affected by the type of the sound playback circuit 12, whether the sound playback circuit 12 is an earphone, an amplifier system or other kinds of sound playback devices.

The sound reproducing apparatus 1 and the sound reproducing method 200 of the present invention can enhance the input sound signal 11 such that after the encoding process and the decoding process are performed on the input sound signal 11, the output sound signal 13 preserves the sense of the direction of the input sound signal 11 without being distorted due to the encoding process.

It should be noted that, in some embodiments, the sound reproducing method 200 may be implemented as a computer program. When the computer program is executed by a computer, an electronic device, or the processor 14 in FIG. 1, this executing device performs the sound reproducing method 200. The computer program can be stored in a non-transitory computer readable storage medium such as a ROM (read-only memory), a flash memory, a floppy disk, a hard disk, an optical disc, a flash disk, a flash drive, a tape, a database accessible from a network, or any storage medium with the same functionality that can be contemplated by persons of ordinary skill in the art to which this disclosure pertains.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A sound reproducing method used in sound reproducing apparatus comprising:

receiving an input sound signal related to listener data and sound source data, wherein the listener data and the sound source data are generated in a real-time manner during a simulated scenario;

performing an encoding process by multiplying the input sound signal by an encoding function matrix to generate an encoding result, wherein a plurality of entries of the encoding function matrix are related to a basis function;

retrieving a decoding function matrix and applying at least one direction parameter to the decoding function matrix, wherein the decoding function matrix compensates a difference between an ideal approximation result and a modeled approximation result of the input sound signal, the ideal approximation result is generated by encoding and decoding a test sound signal with a first encoding function matrix and a first decoding function matrix corresponding to the basis function having infinite indeterminates, the modeled approximation result is generated by encoding and decoding the test sound signal with a second encoding function matrix and a second decoding function matrix corresponding to the basis function having finite indeterminates, and the decoding function matrix is generated by multiplying the second decoding function matrix by a compensation matrix generated according to the difference;

performing a decoding process by multiplying the encoding result by the decoding function matrix having the direction parameter applied to generate an output sound signal; and reproducing the output sound signal.

2. The sound reproducing method of claim 1, wherein the basis function is spherical harmonics.

3. The sound reproducing method of claim 1, wherein the first decoding function matrix is an inverse matrix of the first encoding function matrix, and the second decoding function matrix is an inverse matrix of the second encoding function matrix.

4. The sound reproducing method of claim 1, wherein the indeterminates correspond to different directional components of the test sound signal.

5. The sound reproducing method of claim 4, wherein the decoding function matrix enhance the directional components corresponding to a transmission direction of the input sound signal according to the difference.

6. The sound reproducing method of claim 1, further comprising:

applying an inverse response to the output sound signal such that the output sound signal is further reproduced, in which the inverse response corresponds to a frequency response characteristic of a sound playback circuit used to reproduce the output sound signal.

7. A sound reproducing apparatus comprising:

a storage configured to store a plurality of computer-executable instructions;

a sound playback circuit; and a processor electrically coupled to the storage and the sound playback circuit and configured to retrieve and execute the computer-executable instructions to perform a sound reproducing method when the computer-executable instructions are executed, wherein the sound reproducing method comprises:

receiving an input sound signal related to listener data and sound source data, wherein the listener data and the sound source data are generated in a real-time manner during a simulated scenario;

performing an encoding process by multiplying the input sound signal by an encoding function matrix to generate an encoding result, wherein a plurality of entries of the encoding function matrix are related to a basis function;

retrieving a decoding function matrix from the storage and applying at least one direction parameter to the decoding function matrix, wherein the decoding function matrix compensates a difference between an ideal approximation result and a modeled approximation result of the input sound signal, the ideal approximation result is generated by encoding and decoding a test sound signal with a first encoding function matrix and a first decoding function matrix corresponding to the basis function having infinite indeterminates, the modeled approximation result is generated by encoding and decoding the test sound signal with a second encoding function matrix and a second decoding function matrix corresponding to the basis function having finite indeterminates, and the decoding function matrix is generated by multiplying the second decoding function matrix by a compensation matrix generated according to the difference;

performing a decoding process by multiplying the encoding result by the decoding function matrix having the direction parameter applied to generate an output sound signal; and reproducing the output sound signal by the sound playback circuit.

8. The sound reproducing apparatus of claim 7, wherein the basis function is spherical harmonics.

9. The sound reproducing apparatus of claim 7, wherein the first decoding function matrix is an inverse matrix of the first encoding function matrix, and the second decoding function matrix is an inverse matrix of the second encoding function matrix.

10. The sound reproducing apparatus of claim 7, wherein the indeterminates correspond to different directional components of the test sound signal.

11. The sound reproducing apparatus of claim 10, wherein the decoding function matrix enhance the directional components corresponding to a transmission direction of the input sound signal according to the difference.

12. The sound reproducing apparatus of claim 10, wherein the so and reproducing method further comprises:

applying an inverse response to the output sound signal such that the output sound signal is further reproduced, in which the inverse response corresponds to a frequency response characteristic of a sound playback circuit used to reproduce the output sound signal.

13. A non-transitory computer readable storage medium that stores a computer program comprising a plurality of computer-executable instructions to perform a sound reproducing method used in a sound reproducing apparatus, the sound reproducing apparatus at least comprises a storage, a sound playback circuit and a processor electrically coupled to the storage and the sound playback circuit and configured to retrieve and execute the computer-executable instructions to perform the sound reproducing method when the computer-executable instructions are executed, wherein the sound reproducing method comprises:

receiving an input sound signal related to listener data and sound source data, wherein the listener data and the sound source data are generated in a real-time manner during a simulated scenario;

performing an encoding process by multiplying the input sound signal by an encoding function matrix to generate an encoding result, wherein a plurality of entries of the encoding function matrix are related to a basis function;

retrieving a decoding function matrix from the storage and applying at least one direction parameter to the decoding function matrix, wherein the decoding function matrix compensates a difference between an ideal approximation result and a modeled approximation result of the input sound signal, the ideal approximation result is generated by encoding and decoding a test sound signal with a first encoding function matrix and a first decoding function matrix corresponding to the basis function having infinite indeterminates, the modeled approximation result is generated by encoding and decoding the test sound signal with a second encoding function matrix and a second decoding function matrix corresponding to the basis function having finite indeterminates, and the decoding function matrix is generated by multiplying the second decoding function matrix by a compensation matrix generated according to the difference;

performing a decoding process by multiplying the encoding result by the decoding function matrix having the direction parameter applied to generate an output sound signal; and reproducing the output sound signal by the sound playback circuit.

14. The non-transitory computer readable storage medium of claim 13, wherein the basis function is spherical harmonics.

15. The non-transitory computer readable storage medium of claim 13, wherein the first decoding function matrix is an inverse matrix of the first encoding function matrix, and the second decoding function matrix is an inverse matrix of the second encoding function matrix.

16. The non-transitory computer readable storage medium of claim 13, wherein the indeterminates correspond to different directional components of the test sound signal.

17. The non-transitory computer readable storage medium of claim 16, wherein the decoding function matrix enhance the directional components corresponding to a transmission direction of the input sound signal according to the difference.

* * * * *